United States Patent [19]

Mauney

[11] 4,065,090

[45] Dec. 27, 1977

[54] CLIP ASSEMBLY FOR CEILING TRACK RAILINGS

[76] Inventor: Harold D. Mauney, 2095 Laura Lane, West Palm Beach, Fla. 33406

[21] Appl. No.: 664,090

[22] Filed: Mar. 5, 1976

[51] Int. Cl.[2] ..... B42F 13/00; A44B 21/00

[52] U.S. Cl. ..... 248/318; 24/73 R; 24/255 R; 248/317; 248/343

[58] Field of Search ..... 24/243 SP, 255 R, 255 S, 24/255 SP, 255 VA, 73 CP, 73 C, 73 AS, 73 GS, 261 C, 261 DS, 261 WL, 261 R, 230 F, 222 BS, 222 SE; 248/74 A, 72, 322, 342, 60, 228, 317, 343, 318; 52/39; 108/149; 403/159; 294/85; 40/128

[56] References Cited

U.S. PATENT DOCUMENTS

| | | | |
|---|---|---|---|
| 2,894,574 | 7/1959 | Micciche | 24/73 B |
| 3,012,640 | 12/1961 | Sluka | 24/261 |
| 3,087,219 | 4/1963 | Roberts | 24/243 SP |
| 3,154,870 | 11/1964 | Hopp | 40/128 |
| 3,417,535 | 12/1968 | Zuckerman | 248/322 |
| 3,582,030 | 6/1971 | Barrett | 24/73 AP |
| 3,618,176 | 11/1971 | Barnes | 248/343 |
| 3,778,537 | 12/1973 | Miller | 248/74 A |
| 3,870,206 | 3/1975 | Feinberg | 248/340 |
| 3,952,985 | 4/1976 | Davenport | 248/317 |

FOREIGN PATENT DOCUMENTS

| | | | |
|---|---|---|---|
| 556,926 | 5/1958 | Canada | 248/342 |
| 401,386 | 5/1966 | Switzerland | 248/228 |
| 682,963 | 11/1952 | United Kingdom | 248/228 |

*Primary Examiner*—Bernard A. Gelak

[57] ABSTRACT

A clip assembly is disclosed for suspending objects from conventional track railings employed for supporting ceilings of the panel type. The clip has oppositely disposed side walls which are joined at one end and which have oppositely disposed end portions projecting inwardly from the free ends of said side walls. The end portions have a flat inner surface which, when slid on or snapped over the track railing, engage the flat surface of the track railing to thereby enable considerable weight to be suspended from a recess in a web integrally formed with said side walls.

2 Claims, 3 Drawing Figures

CLIP ASSEMBLY FOR CEILING TRACK RAILINGS

BACKGROUND OF THE INVENTION a. Field Of The Invention

This invention relates to clip assemblies and more particularly to a clip which can be slid over or snapped onto conventional track railings for suspending objects of relatively heavy weight.

b. Background of the Invention and Objects

Applicant is unaware of any clip assembly constructed in the manner herein disclosed which can easily be slipped onto or snapped over conventional track railings for supporting ceilings of the panel type and from which, due to several unique features, can be suspended objects of considerable weight. Clip assemblies of which applicant is aware are of the general types disclosed in the U.S. Pat. to F. A. Roberts No. (3,087,219) and H. R. Bohanon No. (3,318,224).

It is therefore the primary object of the present invention to provide a new and improved clip assembly which enables relatively heavy objects to be suspended from conventional ceiling track railings.

It is another object of the present invention to provide a clip assembly which can be easily attached, moved on and removed from conventional ceiling track railings.

It is a further object of the invention to provide a clip which, due to its unique construction, is capable of having objects weighing of up to twenty-five pounds suspended therefrom.

It is yet another object of the invention to provide such a clip of one piece molded construction which is relatively inexpensive to make and easy to use.

Various other objects and advantages of this invention will be fully apparent to those skilled in the art to which this invention pertains from a detailed consideration of the remainder of this description including the appended claims and the accompanying drawings in which:

DETAILED DESCRIPTION OF THE PREFERRED EMBODIMENT

Figures 1, 2, 3:
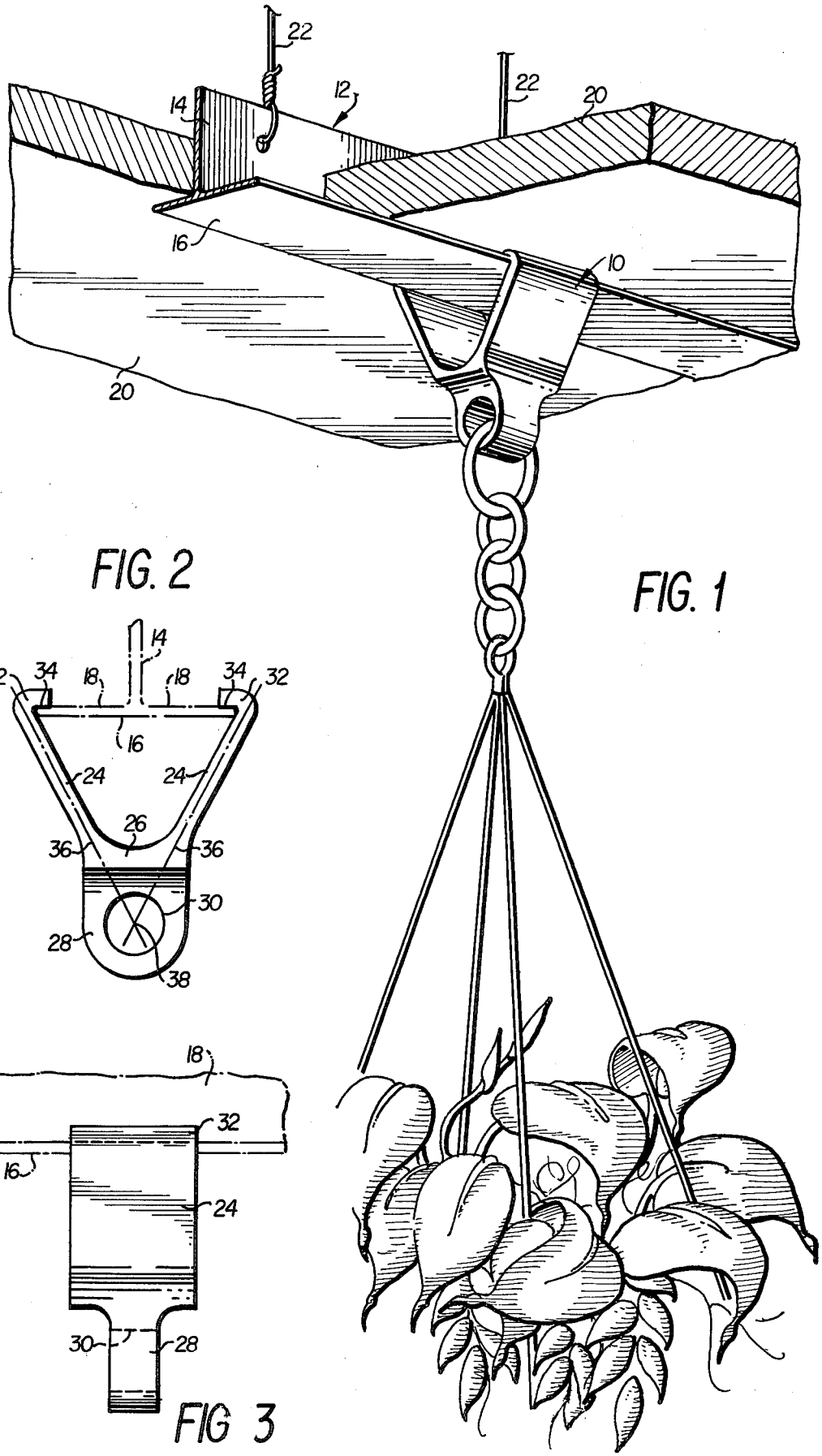
FIG. 1 is a perspective view of the clip assembly of the present invention attached to a conventional ceiling track railing.
FIG. 2 is an end elevational view of the clip assembly.
FIG. 3 is a side elevational view of the clip assembly.

Referring now to the drawings where like numerals are used to designate like parts in each figure, 10 designates generally the clip assembly of the present invention adapted to be positioned on a ceiling track railing 12 as shown in FIG. 1.

The ceiling track railing 12 is of conventional design and well known in the art of supports for suspended ceilings of the panel type. The railing 12 is T-shaped in cross-section and has a stem portion 14 and a cross portion 16. The cross portion 16 has flat inner surfaces 18 on which rest the panels 20 comprising the ceiling. The railings 12 are suspended from the upper ceiling structure (not shown) by means of wires 22 or the like connected to the stem portion 14.

The clip assembly 10 is of one piece construction and made of a substantially rigid material such as nylon. The clip 10 has opposed side walls 24 and an end wall 26 to which one end of the side walls 24 are joined. The end wall 26 has a web portion 28 formed therewith and a circular recess or hole 30 is formed therethrough to which can be attached the object to be suspended as shown in FIG. 1. The side walls 24 have end portions 32 formed on the free ends thereof and which extend inwardly of the side walls 24. The end portions 32 are disposed opposite to and spaced from each other. Each end portion 32 has a flat inner surface 34 which lies in the same plane.

It is essential that both inner surfaces 34 be flat and in the same plane so that they can engage the correspondingly flat surface 18, shown by phantom lines, for the substantial length of the inner surface 34. This mating of flat surfaces 18, 34 enables a considerably greater amount of weight to be suspended from the clip assembly without danger of the clip becoming detached than would be possible if the surfaces 34 were not flat and in the same plane.

In order to minimize the possibility of outward flexing of the side walls 24 and end wall 26 when the clip assembly is under a tension load, i.e., an object of considerable weight being suspended therefrom, the side walls 24 converge toward the circular recess 30 such that planes 36 extending through the approximate midpoint of the walls 24, as shown in FIG. 2, intersect at the center 38 of the circular recess 30. By positioning the side walls 24 relative to the circular recess 30 in this manner, the tension load is transmitted in a straight line to end portions 32.

In order to attach the clip assembly 10 to the track railing 12, the assembly is held in one hand between the thumb and forefinger and the end portion 32 adjacent the forefinger is positioned on one surface 18. Slight pressure exerted by the forefinger on the side wall 24 adjacent thereto while holding the free end projection 32 with the thumb will result in the space between end projections 32 to be enlarged sufficiently to enable the end projection adjacent the thumb to be positioned on the other surface 18 of the track railing 12. The same procedure can be followed for detaching the clip assembly 10.

The foregoing description is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

What I claim is:

1. A clip assembly formed out of a single piece of substantially rigid material for suspending objects from ceiling track railings having flat ceiling supporting surfaces, said clip comprising:

a. opposed side walls and an end wall joining one end of each of said side walls, said side walls extending substantially their entire length at an angle relative to each other, the other end of each of said side walls having an end portion formed inwardly thereof such that the end portion of each side wall is disposed opposite the other and spaced therefrom, said end portions having an inner surface area which is flat and which lies in the same plane for engaging said flat ceiling supporting surfaces of said track railing, and b. web means integrally formed with said end wall, said web means having a recess formed therethrough for suspending said objects, said angle having a vertex at the approximate center of said recess through said web.

2. A clip assembly formed out of a single piece of substantially rigid material for suspending objects from ceiling track railings having flat ceiling supporting surfaces, said clip comprising opposed, slightly flexible side walls and an end wall joining one end of each of said side walls, said side walls extending substantially their entire length at an angle relative to each other, the other end of each of said side walls having an end portion formed inwardly thereof such that the end portion of each side wall is disposed opposite the other and spaced therefrom, said end portions having an inner surface area which is flat and which lies in the same plane for engaging said flat ceiling supporting surfaces of said track railing , and web means integrally formed with said end wall for suspending said objects, said angle having a vertex in said web, said web means terminating a short distance from said vertex and having edge means for engaging said suspended objects.

* * * * *